US007439434B1

(12) United States Patent
Cole et al.

(10) Patent No.: US 7,439,434 B1
(45) Date of Patent: Oct. 21, 2008

(54) MULTI-COMPONENT PERCUSSION MALLET

(75) Inventors: Stephen J. Cole, Arcata, CA (US); Ronald L. Samuels, Arcata, CA (US)

(73) Assignee: Marimba One Inc., Arcata, CA (US)

( * ) Notice: Subject to any disclaimer, the term of this patent is extended or adjusted under 35 U.S.C. 154(b) by 122 days.

(21) Appl. No.: 11/330,950

(22) Filed: Jan. 11, 2006

(51) Int. Cl.
*G10D 13/02* (2006.01)

(52) U.S. Cl. ..... 84/422.4

(58) Field of Classification Search ..... 84/422.4; 81/19

See application file for complete search history.

(56) References Cited

U.S. PATENT DOCUMENTS

| | | | | | |
|---|---|---|---|---|---|
| 1,606,522 | A | * | 11/1926 | Freedlander et al. | 473/558 |
| 2,473,865 | A | * | 6/1949 | Dane | 84/404 |
| 3,688,013 | A | * | 8/1972 | Menard | 84/422.4 |
| 3,998,123 | A | * | 12/1976 | Hinger | 84/422.4 |
| 4,307,647 | A | | 12/1981 | Christian | |
| 4,452,289 | A | * | 6/1984 | Smith | 81/177.1 |
| 4,545,836 | A | * | 10/1985 | Lidster | 156/185 |
| 4,649,792 | A | * | 3/1987 | Swartzlander | 84/422.4 |
| 4,763,557 | A | * | 8/1988 | Donohoe | 84/422.4 |
| 5,224,642 | A | * | 7/1993 | Davis et al. | 226/190 |
| 5,341,716 | A | * | 8/1994 | Donohoe | 84/422.4 |
| 5,361,671 | A | * | 11/1994 | Genna | 84/422.4 |
| 5,400,685 | A | * | 3/1995 | Cappella | 84/422.4 |
| 5,693,900 | A | * | 12/1997 | Calato et al. | 84/422.4 |
| 5,740,586 | A | * | 4/1998 | Gomas | 16/436 |
| 5,925,840 | A | * | 7/1999 | Senn | 84/422.4 |
| 5,929,356 | A | | 7/1999 | Piland et al. | |
| 6,082,721 | A | * | 7/2000 | Kingsley | 267/276 |
| 6,307,138 | B1 | | 10/2001 | Simpson | |
| 6,960,712 | B2 | * | 11/2005 | Citron et al. | 84/422.2 |
| 6,994,638 | B2 | * | 2/2006 | Rajagopalan et al. | 473/377 |
| 7,329,194 | B2 | * | 2/2008 | Watanabe et al. | 473/376 |
| 2003/0207728 | A1 | * | 11/2003 | Reid et al. | 473/351 |

* cited by examiner

*Primary Examiner*—Lincoln Donovan
*Assistant Examiner*—Robert W Horn
(74) *Attorney, Agent, or Firm*—David Pressman, Esq.

(57) ABSTRACT

An improved mallet for percussive musical instruments comprises, in one embodiment, a shaft (1100, 1200, etc.), an adapter or inner core (300, 1400), an elastomeric surrounding core (400), and an elastomeric core overlay (1200). Optionally a cover (1300), or optionally two simultaneously-wound layers of yarn or other wrapping material (1705, 1710) are attached over the assembly. The adapter or inner core and the elastomeric surrounding core are formed together in molds (700, 900). Yarns are wrapped either by hand or with the use of a wrapping machine comprising a rotary motive source, a chuck (1810), and wrapping arms (1825, 1830) for interweaving the layers of yarn. In an alternative embodiment the adapter has a through-hole to permit extension of the shaft through the adapter to near the top of the mallet head. Numerous percussive sound effects are achieved by selection of the properties of the adapter or inner core, surrounding core, overlay, and yarn layers.

30 Claims, 10 Drawing Sheets

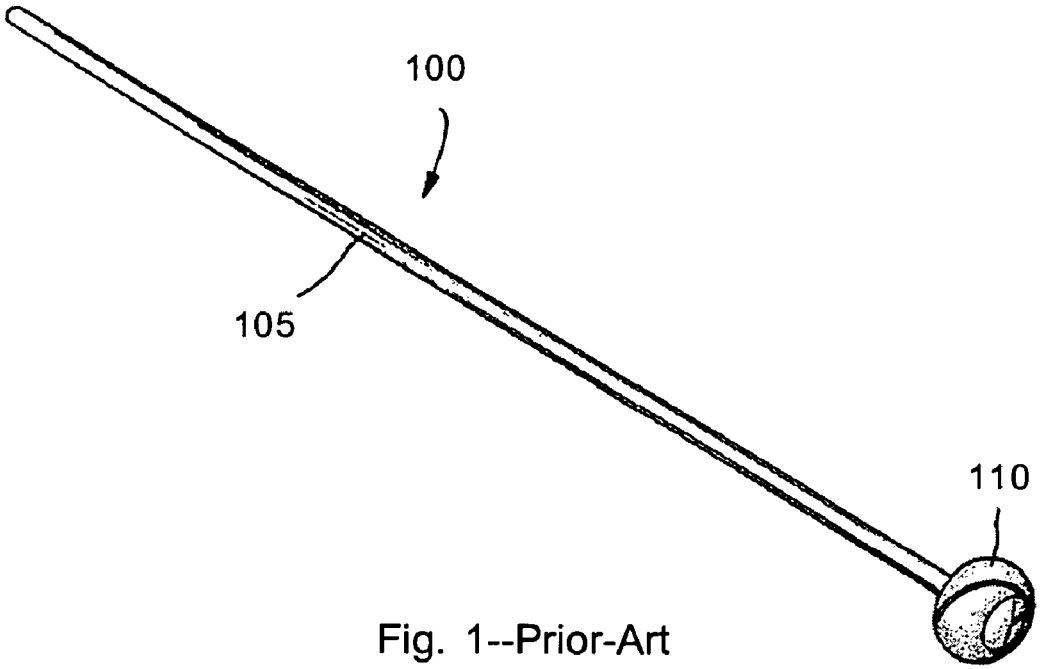
Fig. 1--Prior-Art
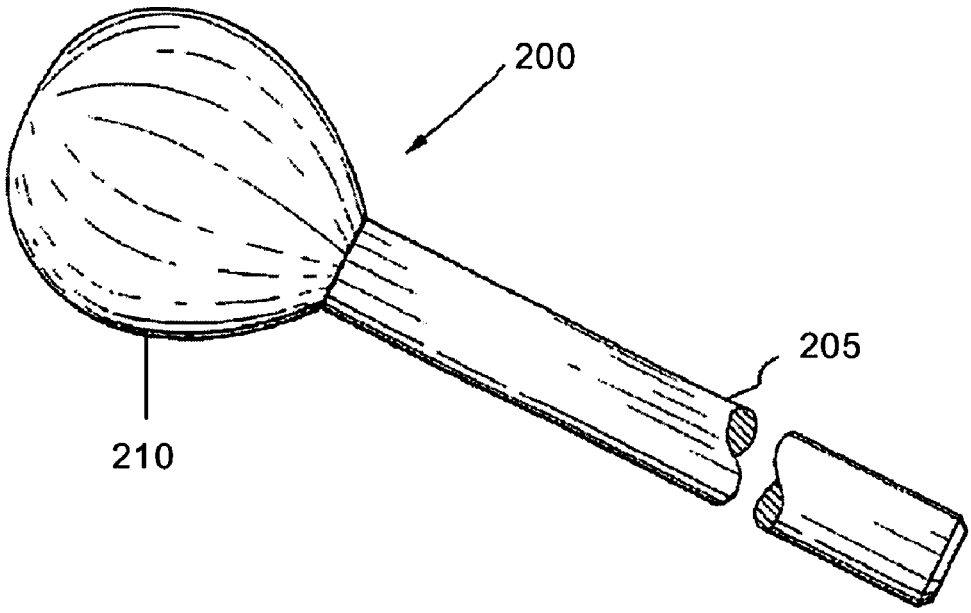
Fig. 2--Prior-Art

MULTI-COMPONENT PERCUSSION MALLET

BACKGROUND

1. Field

This relates to percussive musical instruments, in particular to mallets for use in striking such instruments.

2. Prior Art—Mallets

Prior-art mallets for playing musical instruments, such as xylophones and marimbas, generally employ a core material comprising either the shaft of the mallet itself, or a hard material, such as metal or plastic, attached to the shaft. Resilient layers that are generally elastomeric (having rubber like springiness) are then affixed around the core. An outer layer is generally formed over the resilient layer.

Prior-art mallets are sold in a variety of shapes and sizes. Because of this, many different musical effects can be produced according to the hardness of the mallet, its composition, weight, and size. Different exterior colors provide decoration and permit the user to pre-select mallets with predetermined striking capabilities. Although prior-art mallets offer a range of performance and appearance, this range is limited by the basic technologies used in their construction.

Mallets Using Layers of Various Materials—FIG. 1

One type of mallet uses a head comprised of multiple layers. For example, in U.S. Pat. No. 3,998,123 (1976), Hinger teaches a mallet comprising a hard shaft with a handle end and a playing head end. A replaceable playing head is installed by sliding an aperture of the head over the shaft from the handle end to the head end. A retainer structure, formed at the head end of the shaft, prevents the playing head from either slipping back toward the hand end or flying off the shaft. The aperture of the playing head is lined with a resilient material, such as neoprene. The neoprene is wrapped with masking tape. The main body of the playing head is felt. The felt is either wrapped over the masking tape and secured either adhesively or by stitching. Alternatively, it may be integrally formed on the inner components of the head assembly and secured by a stitched cover (not shown).

In U.S. Pat. No. 4,307,647 (1981), Christian teaches a mallet comprising a shaft with a handle end and a head end, a tubular rubber shock absorber mounted at the head end, a wooden disc surrounding the shock absorber, and a rubber band secured to the outer surface of the wooden disc. The shock absorber is glued to the head end of the shaft. The rubber band is glued to the outer surface of the disc. The wooden disc and rubber band are shaped so that striking the musical instrument with the flat, outer surface of the rubber band produces a forte sound, and striking the instrument with the edge of the rubber band produces a piano sound.

In U.S. Pat. No. 4,545,836 (1985), Lidster teaches a mallet and method for making the mallet. The mallet of FIG. 1 comprises a shaft 105 and an attached head 110 formed of rubber. Pigments of various colors are added to liquid rubber which is then hardened into layer strips. These strips are wrapped about a spheroid (not shown in this view) at the head end of the mallet. The tightness of the wrap is associated with a particular pigment color. The musician selects from a set of mallets in a range of colors in order to predictably set the timbre of the note struck by the mallet.

In U.S. Pat. No. 5,929,356 (1999), Piland et al. teach a mallet with a striking head at one end of a shaft and a cushioned handle at the other end. The striking head comprises a rubber cylinder with radiused edges and an axial opening. The axial opening of the head is glued to the shaft. A layer of short flocking fibers is adhered to the surface of the head. The fibers protrude outwardly from the surface.

In U.S. Pat. No. 6,307,138 (2001), Simpson teaches a mallet comprising a shaft with first and second striking heads at opposite ends of the shaft. The first head is made of a soft material, such as felt. The second head is made of a non-fibrous material, such as a plastic. The second head is harder than the first head. In use, the player creates sounds of two different timbres depending on which end of the mallet is used.

Mallets with Wrapped Striking Ends—FIG. 2

Another type of mallet uses a striking end wrapped in yarn or a similar material. For example, in U.S. Pat. No. 4,649,792 (1987) Swartzlander teaches a mallet 200 including a shaft 205 and a head portion 210 (FIG. 2). Head portion 210 includes a cylindrical core (not shown), an annular sound ridge surrounding the core (not shown), and a yarn covering encasing the core and sound ridge. Strips comprising alternate layers of tape and a sheet material such as paper are wound on the shaft to form the cylindrical core. Narrower strips of similar materials are wound on top of the core at its axial center to form the sound ridge. A first yarn layer is wound over the sound ridge. A second yarn layer is subsequently wound over the entire head, including the core, sound ridge, and first yarn layer. The yarn layers fill in the discontinuities between the sound ridge and the core to form a substantially spherical smooth surface for the mallet head.

Mallets of both of the above prior-art types are sold by Innovative Percussion, Inc., of Nashville, Tenn., USA, Pro-Mark Corporation, of Houston, Tex., USA, and Encore Mallets, of Lewisville, Tex., USA, among others. Prior-art mallets are typically between 27 and 41 cm long. The shaft and head diameters are typically 1 cm and 3.8 cm, respectively.

While all of the above prior-art mallets are useful for generating music from percussion instruments, each design suffers from one or more drawbacks. With regard to the layered types, for example, winding layers of alternate materials is labor-intensive. Gluing successive members to a shaft and to each other is time-consuming. Coloring and subsequently curing liquid rubber prior to winding on a spheroid is both time-consuming and labor-intensive.

The prior-art mallets which are wrapped also suffer from various drawbacks. For example, Swartzlander's design requires two separate, sequential yarn-wrapping steps in addition to two layering steps. The prior-art mallets available on the market today are typically wrapped with cord comprising a single strand. This strand may be of wool, wool plus a synthetic fiber, and the like. One model, the EG-1 sold by Pro-Mark, uses yarn that is alternately one color then another along its length. This provides a decorative effect.

SUMMARY

An improved mallet includes a shaft, a core, and one or more outer layers of different compositions, and an exterior volume wrapped simultaneously with one or more yarns of the same or different types.

ADVANTAGES

Accordingly one or more aspects may have one or more of the following advantages. In one aspect, the mallet is of simple construction, with a design that can be made to have different characteristics, beyond those available with simple prior-art constructions, by varying the composition of its components. For example, mallets can be provided with varying degrees of hardness, resiliency, weight, and size. It is also an advantage to wrap a mallet with yarn in such a way that the yarn remains in place and does not unravel. Another advantage of one or more aspects can be realized by wrapping a mallet with different colors and textures of yarn, providing both a distinctive appearance and new mechanical properties.

Other advantages and features of various aspects will become apparent by a review of the specification, claims, and appended figures.

DRAWING FIGURES

FIG. 1 shows a prior-art mallet with a rubber head.

FIG. 2 shows a prior-art mallet with a yarn-wrapped head.

Figure 3A:
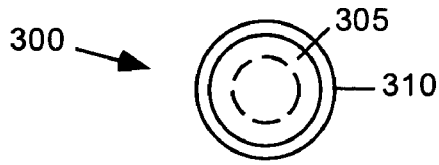
Figure 3B:
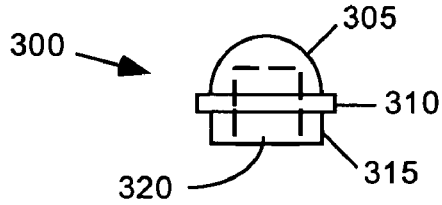
Figure 3C:
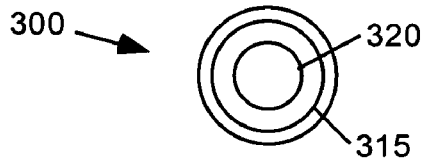

FIGS. 3A, 3B, and 3C show top, side, and bottom views of an adapter used in the mallet.

Figure 4A:
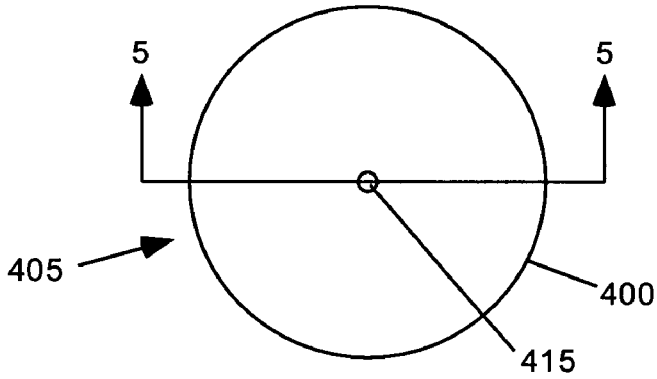
Figure 4B:
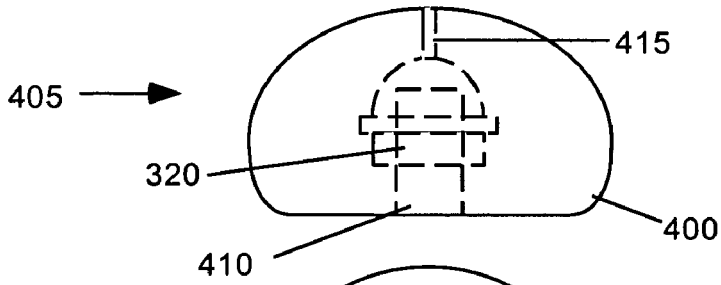
Figure 4C:
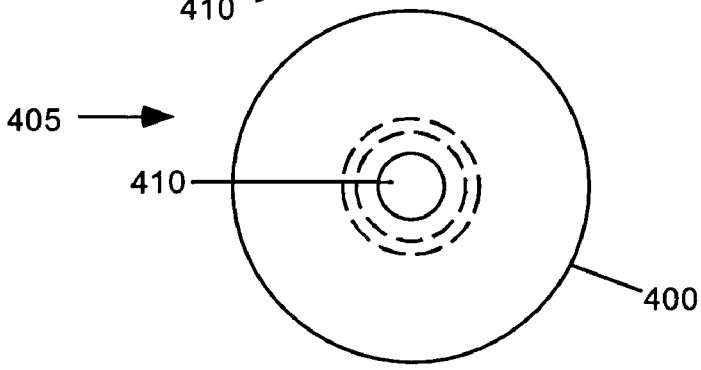

FIGS. 4A, 4B, and 4C show top, side, and bottom views of a first core used in the mallet.

Figure 5:
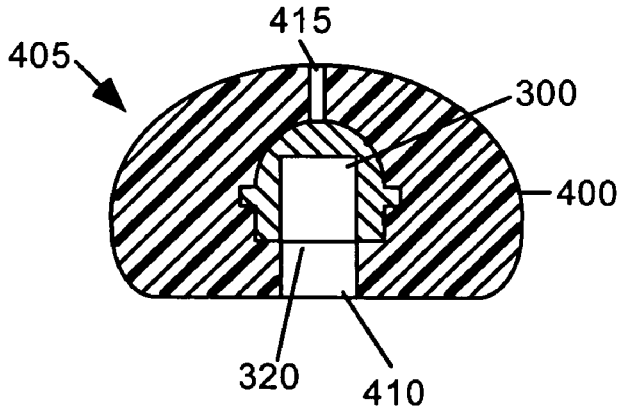

FIG. 5 is a cross-sectional view of the adapter and core of FIGS. 3 and 4, assembled.

Figure 6:
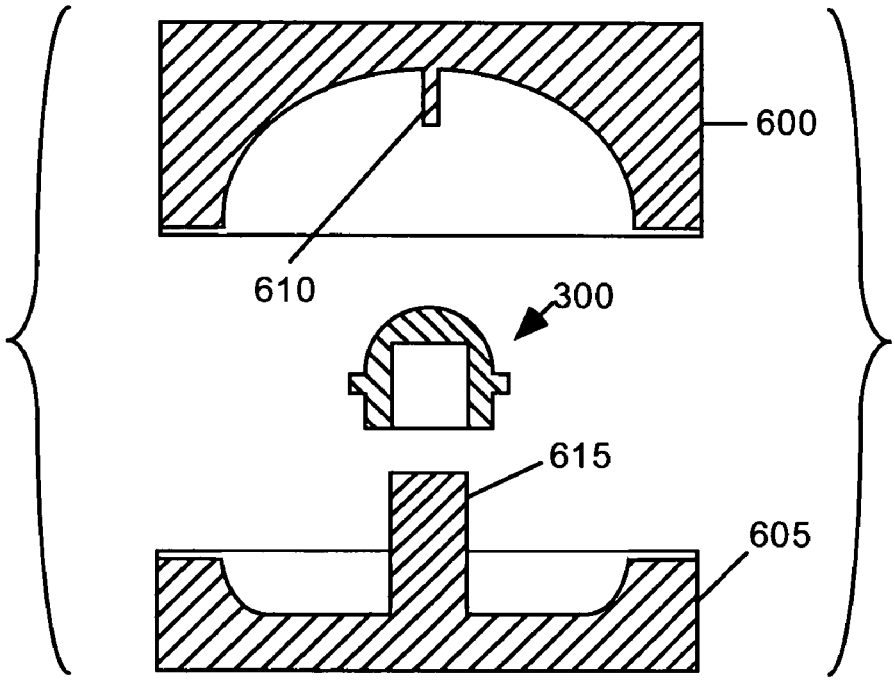

FIG. 6 shows an exploded, cross-sectional view of a first casting mold and the adapter prior to casting the first core.

Figure 7:
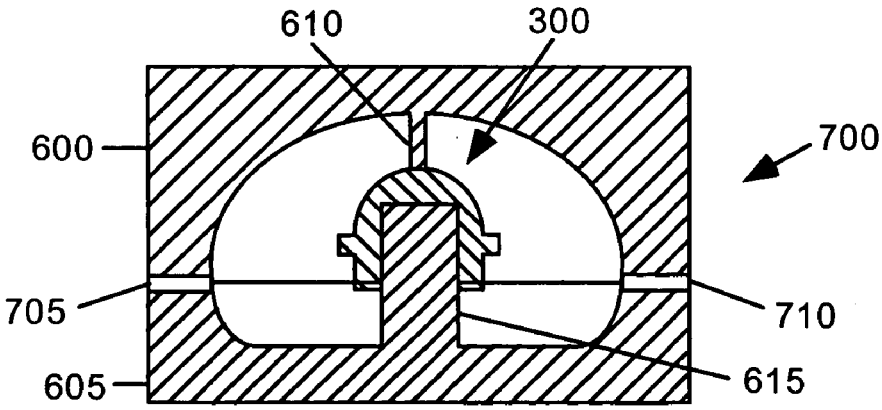

FIG. 7 is a cross-sectional view of the mold and adapter of FIG. 6, in position for casting the first outer core.

Figure 8:
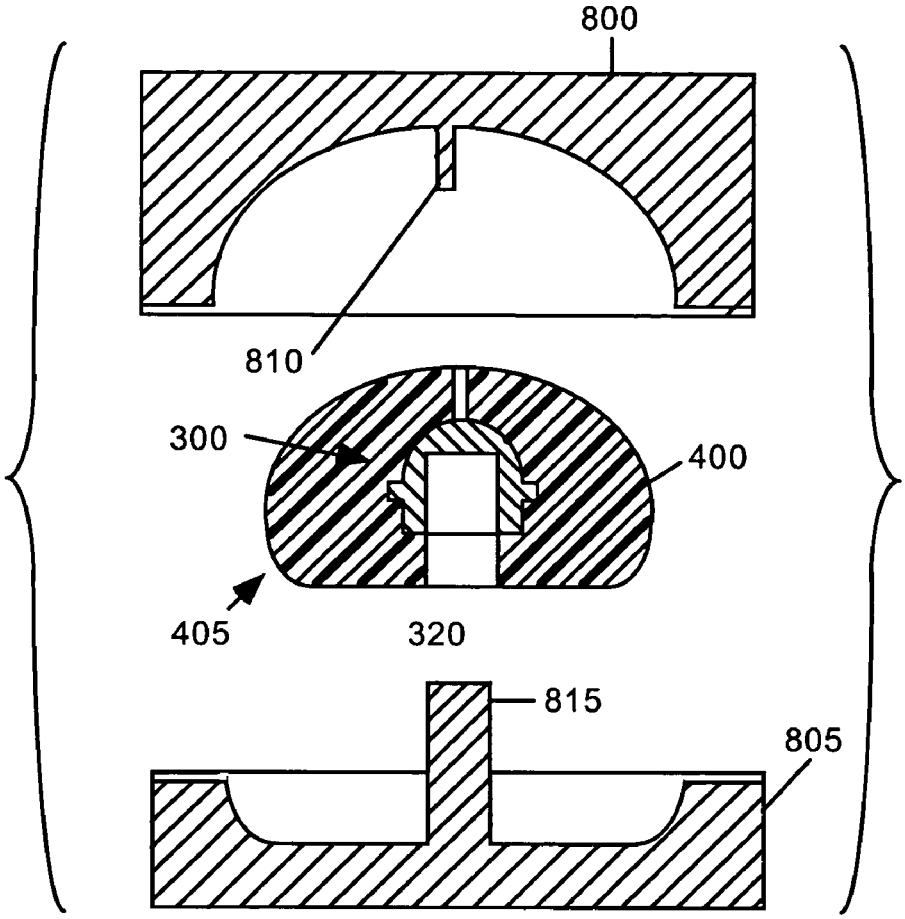

FIG. 8 shows an exploded, cross-sectional view of a second casting mold and the adapter and first core.

Figure 9:
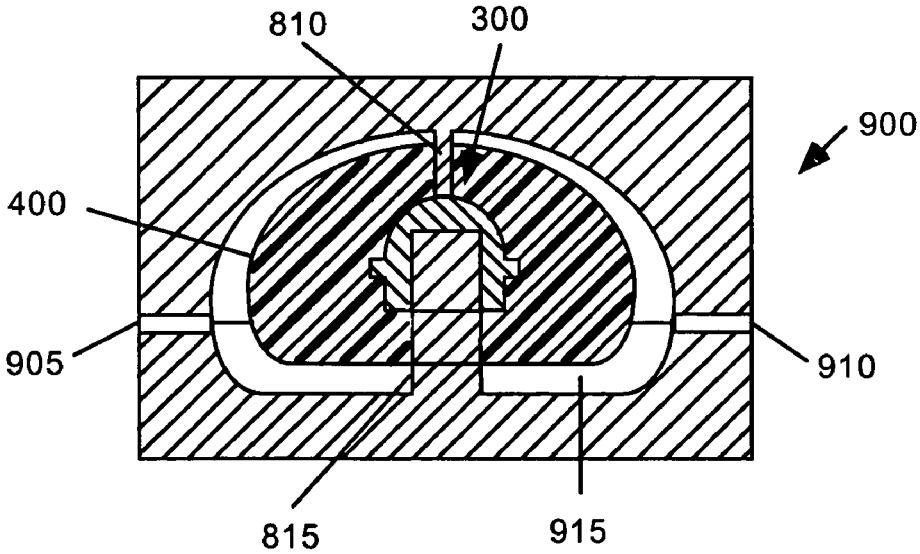

FIG. 9 is a cross-sectional view of the mold of FIG. 8, in position for casting a second core over the first core.

Figure 10:
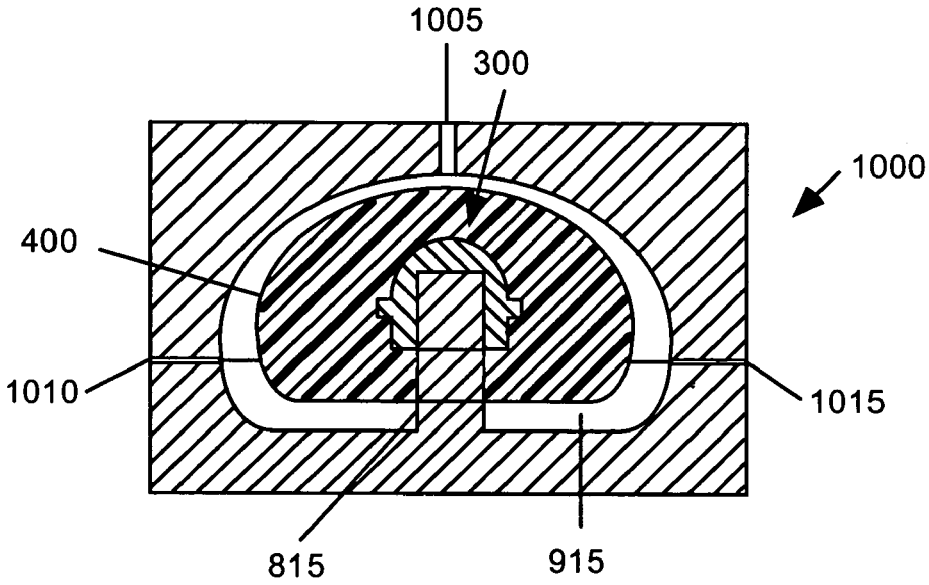

FIG. 10 is a cross-sectional view of a preferred mold with slits for vents.

Figure 11:
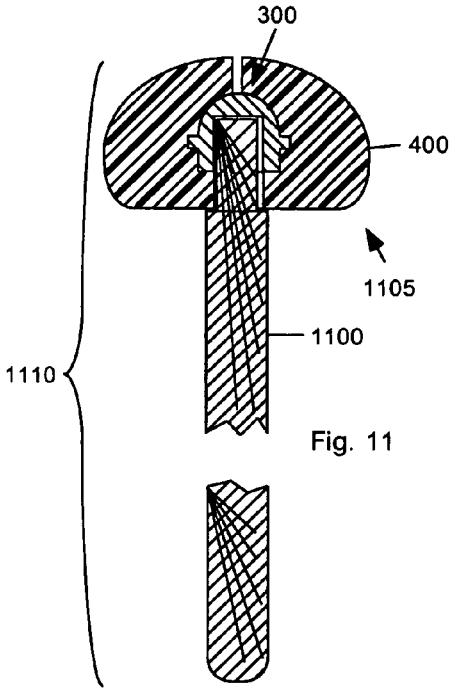

FIG. 11 is a cross-sectional view of a mallet with an inner and first outer core.

Figure 12:
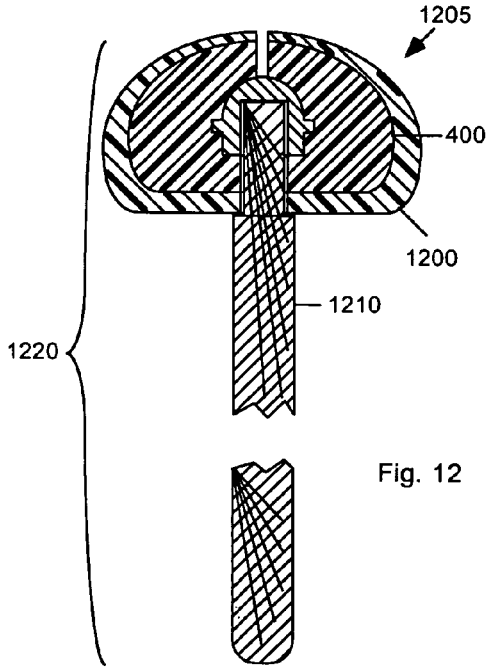

FIG. 12 is a cross-sectional view of a mallet with an adapter, a first core, and a second core over-molded on the first outer core.

Figure 13:
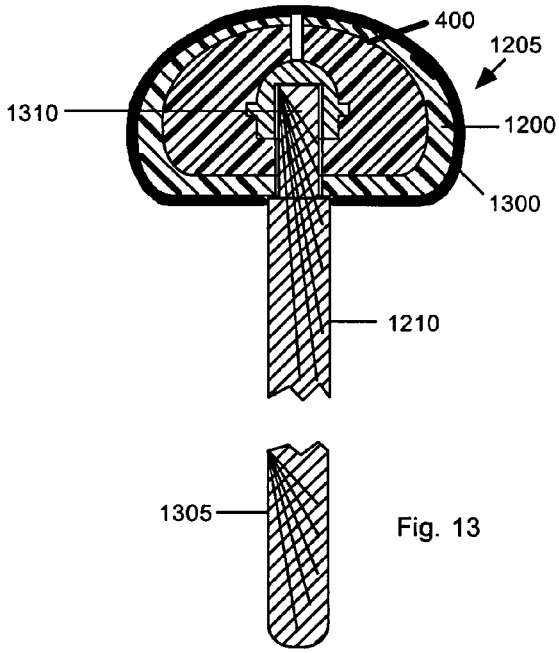

FIG. 13 shows the mallet of FIG. 11 with an exterior covering.

Figure 14:
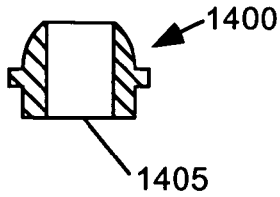

FIG. 14 is a cross-sectional view of an adapter with an axial through-hole.

Figure 15:
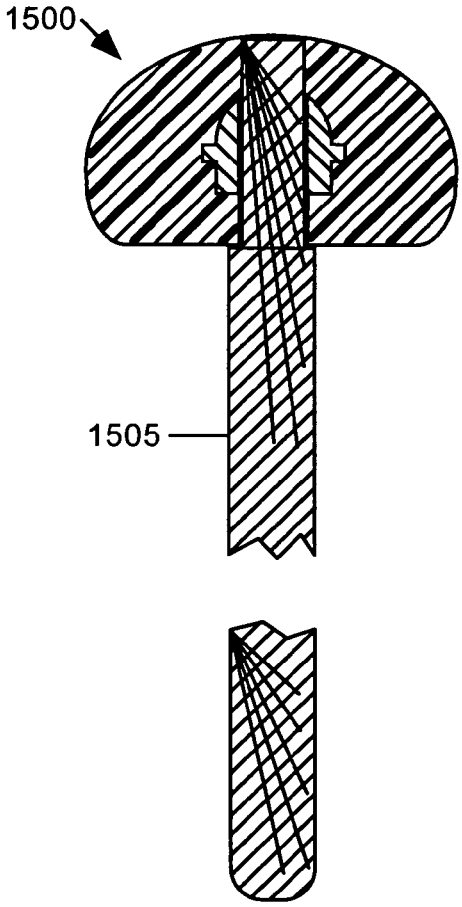

FIG. 15 is a cross-sectional view of a mallet with an extended shaft.

Figure 16:
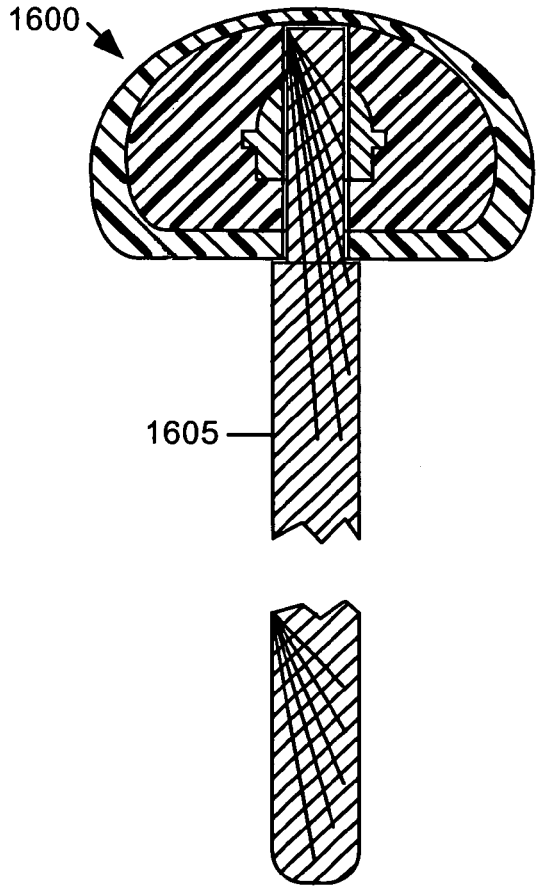

FIG. 16 is a cross-sectional view of a mallet with an extended shaft.

Figure 17:
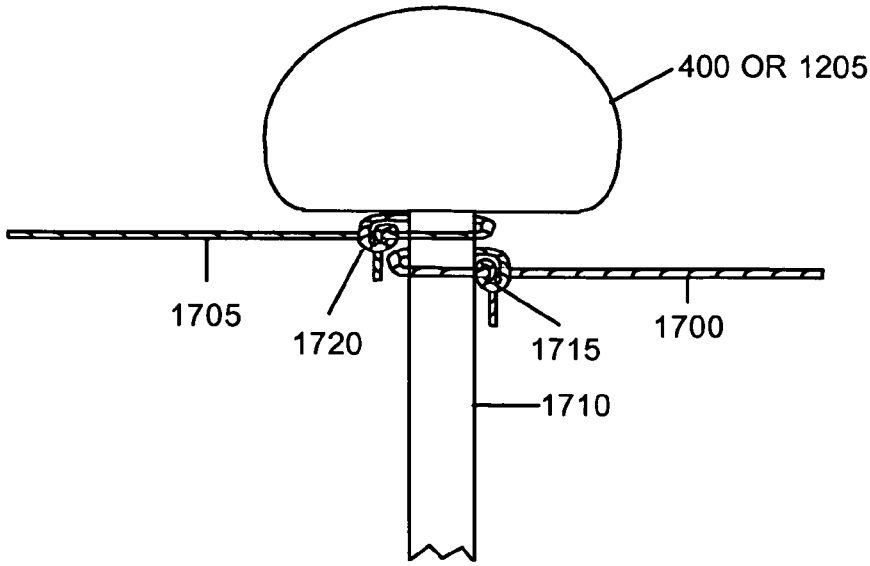

FIG. 17 shows knots attaching two sections of yarn to the shaft of a mallet, prior to winding.

Figure 18:
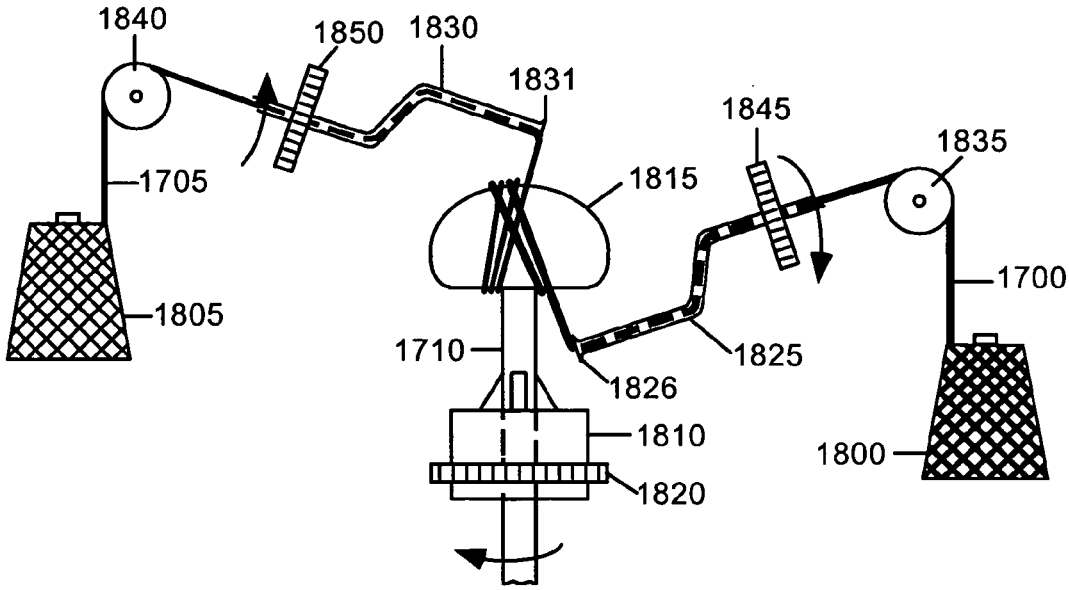

FIG. 18 shows a mallet and machinery in the process of winding two layers of yarn around the mallet head.

Figure 19:
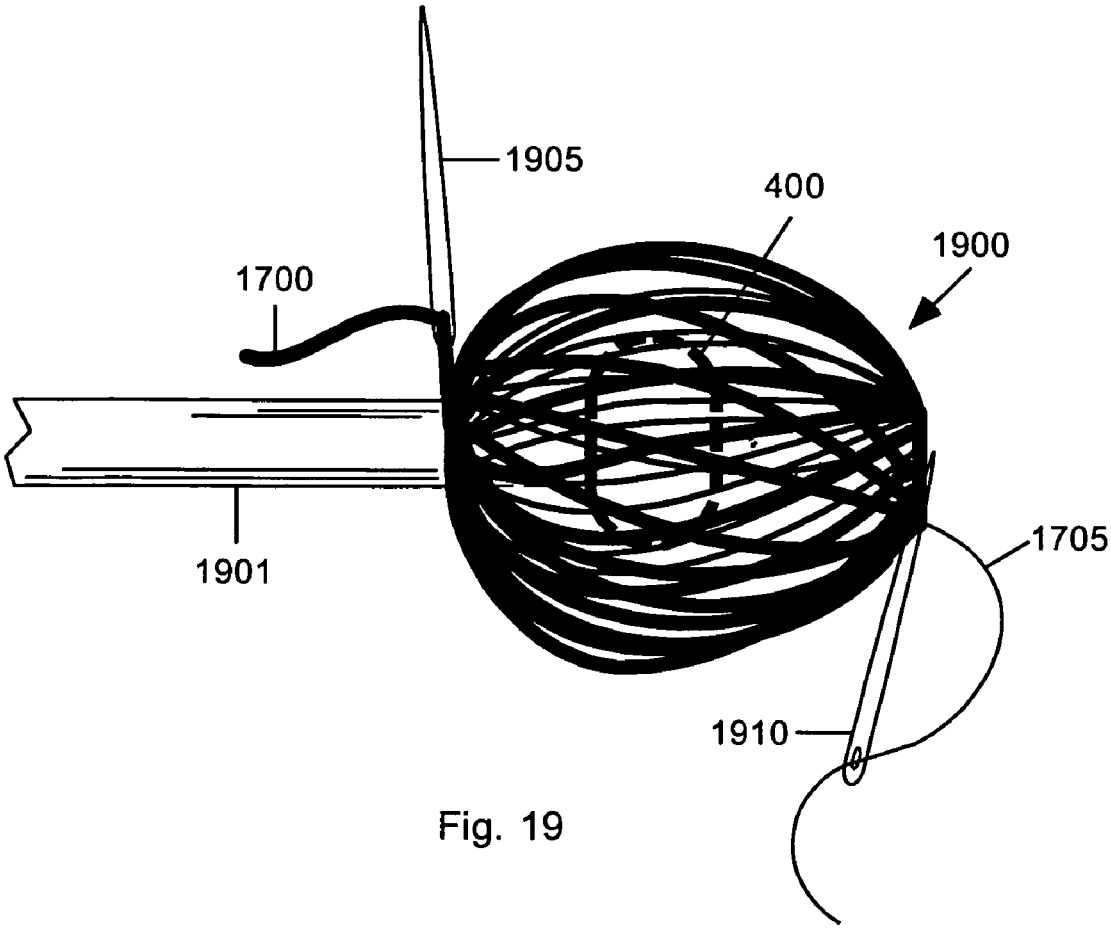

FIG. 19 is a side view of a nearly finished mallet head with a single outer core wrapped with two layers of yarn.

Figure 20:
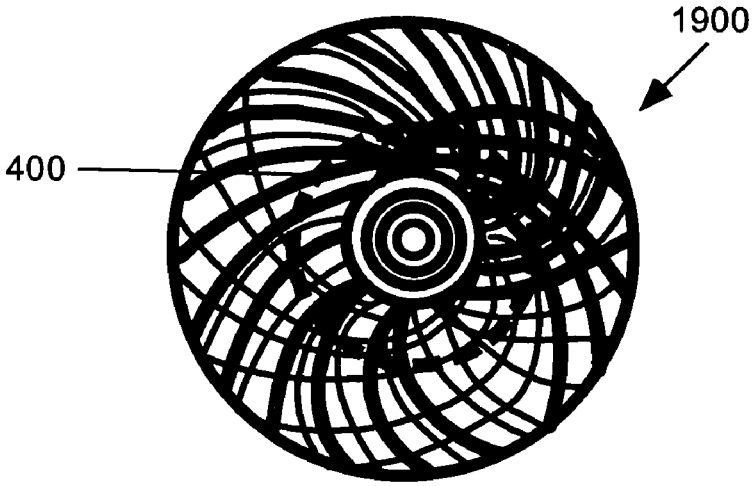

FIG. 20 is an end view of the mallet of FIG. 14.

Figure 21:
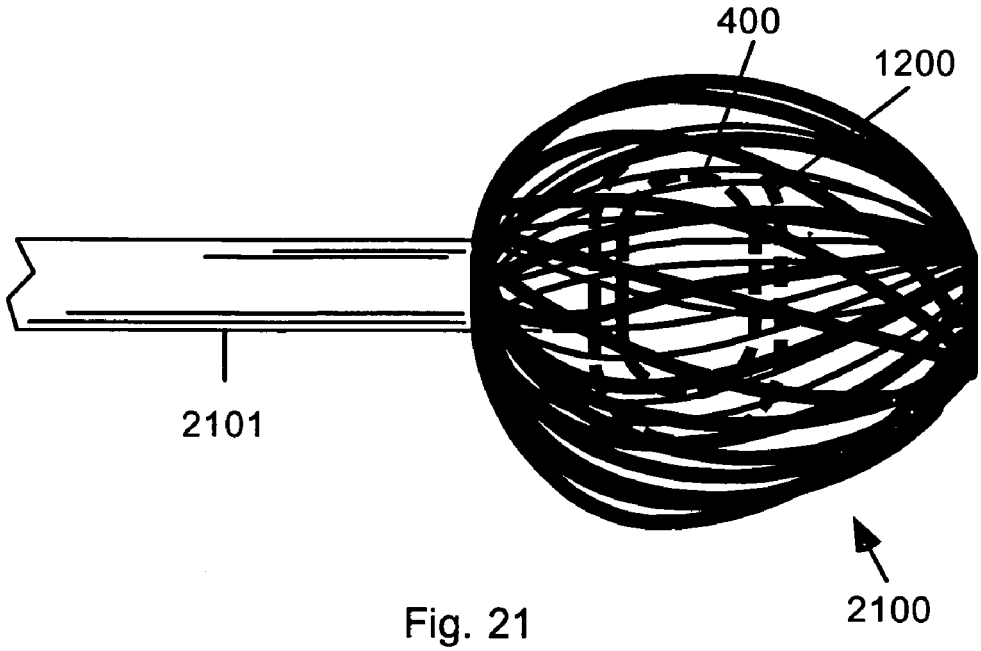

FIG. 21 is a side view of a finished mallet head with first and second cores wrapped with two layers of yarn.

Figure 22:
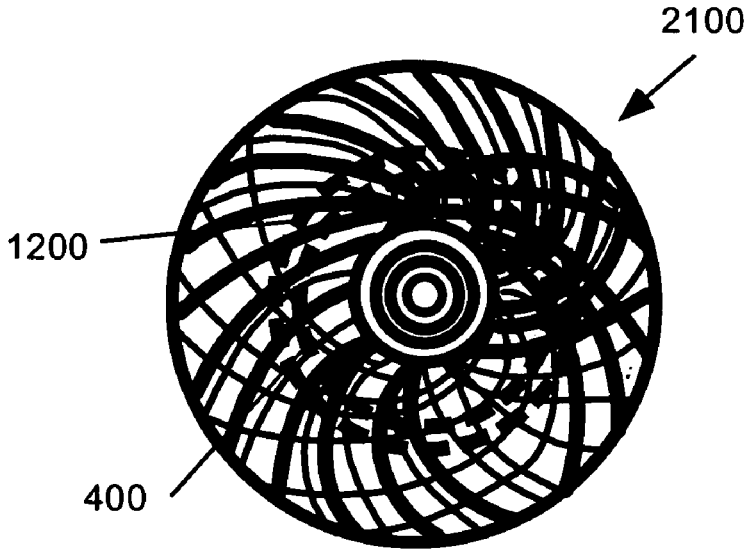

FIG. 22 is an end view of the mallet of FIG. 17.

REFERENCE NUMERALS

| | | | |
|---|---|---|---|
| 100 | Prior-art mallet | 105 | Prior-art shaft |
| 110 | Prior-art head | 200 | Prior-art mallet |
| 205 | Prior-art shaft | 210 | Prior-art head |
| 300 | Adapter | 305 | Top |
| 310 | Annular section | 315 | Base section |
| 320 | Hole | 400 | Layer |
| 405 | Core | 410 | Hole |
| 415 | Hole | 600 | Upper-half mold |
| 605 | Lower-half mold | 610 | Projection |
| 615 | Projection | 700 | Mold |
| 705 | Inlet | 710 | Outlet |
| 800 | Upper-half mold | 805 | Lower-half mold |

-continued

REFERENCE NUMERALS

| | | | |
|---|---|---|---|
| 810 | Projection | 815 | Projection |
| 900 | Mold | 905 | Inlet |
| 910 | Outlet | 915 | Space |
| 1000 | Mold | 1005 | Inlet |
| 1010 | Slit | 1015 | Slit |
| 1100 | Shaft | 1105 | Core |
| 1110 | Mallet | 1200 | Layer |
| 1205 | Core | 1210 | Shaft |
| 1220 | Mallet | 1300 | Layer |
| 1305 | Handle end | 1310 | Head end |
| 1400 | Adapter | 1405 | Hole |
| 1500 | Mallet | 1505 | Shaft |
| 1600 | Mallet | 1605 | Shaft |
| 1700 | Yarn | 1705 | Yarn |
| 1710 | Shaft | 1715 | Knot |
| 1720 | Knot | 1800 | Yarn source |
| 1805 | Yarn source | 1810 | Chuck |
| 1815 | Core | 1820 | Sprocket |
| 1825 | Arm | 1826 | Exit |
| 1830 | Arm | 1831 | Exit |
| 1835 | Tensioner | 1840 | Tensioner |
| 1845 | Sprocket | 1850 | Sprocket |
| 1900 | Head | 1901 | Shaft |
| 1905 | Needle | 1910 | Needle |
| 2100 | Head | 2101 | Shaft |

DESCRIPTION

First Embodiment—Mallet Head Including Adapter—FIGS. 3A-3C

A mallet head core is shown in FIGS. 3A-3C and is formed around an inner adapter or inner core 300 which provides weight balance and secures the mallet head to the head end of the mallet shaft (not shown). FIGS. 3A-3C show top, side, and bottom views of adapter 300. Adapter 300 is preferably 12 mm high and includes a rounded top portion 305 with a diameter of 12 mm and a height of 6 mm. An annular section 310 with a diameter of 13 mm and a height of 2 mm encircles a cylindrical base section 315 that extends down from top portion 305 and has a diameter of 12 mm and a height of 3 mm, respectively. A blind hole 320 is formed on the axis of adapter 300 and admits one end of the shaft or stick (not shown in this view) for holding the mallet head. Hole 320 is preferably 7 mm and 9 mm in diameter and depth, respectively.

Adapter 300 is preferably made of a metal such as aluminum. Alternatively, it can be made of another metal or metallic alloy, plastic, wood, or any suitable material. The material is selected for the weight it imparts to the mallet head. Adapter 300 may be made larger or smaller in order to accommodate mallet heads of varying size and provide predetermined weights.

Mallet Core

FIGS. 4A-4C and 5

Adapter 300 is overlaid with or inserted in a formed, cast, or molded elastomer layer or overlay 400 (FIGS. 4A-4C) to create a core, mallet head or mallet core 405 (FIG. 5). FIGS. 4A, 4B, and 4C show top, side, and bottom views of core 405, respectively. A cross-sectional view of adapter 300 and core 405 is shown in FIG. 5. The diameter of core 405 is preferably about 3.8 cm. Adapter 300 is preferably cast or molded in place during the forming of core 405, as described below.

Layer 400 is preferably made from a resilient thermoplastic elastomer, such as those sold under the marks Dynaflex and Kraton by the GLS Corporation, of McHenry, Ill., USA. Hardness values, determined by the well-known Shore A method, vary between 40 and 90.

A hole 410 formed in the bottom part of layer 400 extends hole 320 of core 300 out through the bottom of first core 405. A second hole 415 in layer 400 is formed by a projection 610 (FIG. 6) on the mold that is used to cast layer 400; projection 610 restrains core 300 from moving during the molding and curing of layer 400. The diameter of projection 610 is typically 2 mm. Layer 400 can be comprised of multiple layers.

Core Mold

FIGS. 6-7

FIG. 6 shows an exploded cross-sectional view of upper and lower halves 600 and 605, respectively, of a mold 700 (FIG. 7) used in molding core 400 over adapter 300.

FIG. 7 shows a cross-sectional view of mold 700 as it is assembled prior to injection of the above-mentioned elastomeric material. Adapter 300 is captured and held in place by projections 610 and 615 in upper and lower mold halves 600 and 605, respectively. The diameter of projection 615 is slightly less than the diameter of hole 320 (FIG. 3C) of adapter 300, so that adapter 300 is able to slide over projection 615.

When mold 700 is assembled, an inlet hole 705, and one or more outlet sprue holes 710 are formed. A single outlet hole 710 is shown in FIG. 7 for clarity. Three such holes, with one or two additional holes located at the parting line of mold 700 are sufficient to vent mold 700.

The elastomeric material to be cast is melted then forced into inlet 705. When mold 700 is full, an excess amount of elastomeric material leaves mold 700 through outlets 710. When mold 700 is full, injection of the molten elastomeric material is stopped, and mold 700 and layer 400 (FIGS. 5 and 8) are allowed to cool. When cool, layer 400 becomes an elastomeric solid and core 405 and adapter 300 are released from mold 700. Sprues from holes 705 and 710 are then removed. The result is an assembly or mallet core 405, ready to be mounted on a shaft 1100 (FIG. 11).

Core Overlay Mold

FIGS. 8-9

Instead of using mallet head 405 as it is currently configured, a second overlay of elastomer is optionally added to produce different properties. FIG. 8 shows an exploded cross-sectional view of a second mold 900 (FIG. 9) comprising top and bottom halves 800 and 805, respectively. Core 405, described above, is shown in position, ready to be captured by top and bottom halves 800 and 805, respectively, of mold 900. Projections 810 and 815 have the same diameter as projections 610 and 615. However they are typically between 1 and 4 mm longer, as required to hold core 405 in place when mold 900 is assembled, as shown in FIG. 9.

When assembled, mold 900 has inlet and outlet sprue holes 905 and 910, respectively. As with mold 700 (FIG. 7), only a single outlet hole 910 is shown for clarity. One or two additional holes located at the parting line of mold 900 are sufficient to vent mold 900.

A space 915 exists between layer 405 and mold 900. A second elastomeric material with different properties than those in layer 405 is liquefied and injected into inlet 905. When space 915 is completely filled, as evidenced by material flowing from exits 910, injection of the elastomeric material is stopped. Mold 900 and new layer 1100 (FIG. 11) are allowed to cool. When they are cool, the new mallet core 1205 (FIG. 12) is released from mold 900.

Alternative Mold Configuration

FIG. 10

A second, preferred, configuration for molding mallet core 405 is shown in FIG. 10. An inlet 1005 is provided at the top of mold 1000. In this new mold, one or more outlet holes 905 (FIG. 9) are replaced by one or more radial slits 1010 and 1015 located on the part line of mold 1000. Slits 1010 and 1015 are preferably between 0.05 and 0.076 mm high and 0.3 cm wide. Although only two slits are shown for clarity, three or four such slits are normally used.

During molding, elastomer is forced to flow into mold 1000 via inlet 1005. Air within mold 1000 escapes through slits 1010, 1015, and any additional vent slits (not shown). Although air is able to escape, the viscosity of the elastomer is such that it does not enter slits 1010, 1015, etc. Mold 1000 is full when all air is vented and no more elastomer is able to enter via inlet 1005.

The same mold configuration can be used in the case of mold 700 (FIGS. 6 and 7). Instead of using projection 610 or 810 to seat adapter 300 firmly on projection 615 or 815, adapter 300 or layer 400 are held in place on projections 615 and 815 by the flowing elastomer during injection.

Partially-Assembled Mallets

FIGS. 11-12

FIG. 11 shows a cross-sectional view of a mallet 1110 comprising core 1105 and adapter 300 mounted on a shaft 1100. Shaft 1100 is preferably between 27 and 41 cm long. The diameter of the top end of shaft 1100 is sized to slide into hole 320 of adapter 300 (FIG. 3C). The top end of shaft 1100 is secured in hole 320 with a durable glue, such as epoxy.

FIG. 12 shows a cross-sectional view of a mallet 1220 comprising core 1205 having a second layer 1200 of elastomer over-molded on first layer 400. The resultant diameter of core 1205 is preferably between 3.5 and 4.5 cm. Shaft 1210 is similar to shaft 1100 (FIG. 11).

First Completed Mallet

FIG. 13

The elastomeric material used in making the above mallet heads is preferably overlaid with a protective and decorative layer in order to form a completed, usable mallet. FIG. 13 shows mallet 1220 (FIG. 12) ready to use with a protective over-layer 1300. Layer 1300 can be a simple overlay of resilient material, such as a vinyl or leather glove, gauntlet, or covering, or it can be a yarn wrapping or overlayment, as described below. The yarn can be one or more strands of wool, cotton, plastic filament, metal wire, and the like.

OPERATION

First Embodiment—FIG. 13

Shaft 1210 (FIG. 13) has a handle end 1305 and a head end 1310. A user's hand normally holds handle end 1305 of shaft 1200, distal from head end 1310 of shaft 1200 to which core 1105 is secured. Wielded in this way, shaft 1210 provides the necessary leverage to cause core 1205 to purposefully strike the sound-generating portion of a percussion instrument, such as a marimba key.

The Shore hardness of layers 400 and 1200 can be different. Preferably the material comprising layer 400 is harder (preferably Shore 80) or softer (preferably Shore 20) than that of layer 1200 (preferably Shore 40). This produces a relatively soft sound. If layer 400 is softer and layer 1200 is harder (i.e. the above Shore values are reversed) the mallet will produce a harder or brighter sound. By selecting both absolute and relative hardness values for layers 400 and 1200, the resulting mallet can produce brighter or less-bright tones when used to strike a percussion musical instrument. The mallet of FIG. 13 is generally lighter than the embodiments discussed below since it is not overlaid with yarn.

DESCRIPTION

Alternative Embodiment—Extended Shaft—FIGS. 14-16

In this embodiment, adapter or inner core 1400 (FIG. 14) has an axial through-hole 1405. All other characteristics of adapter 1400 are the same as for adapter 300, described above.

FIGS. 15 and 16 show mallets 1500 and 1600 with shafts 1505 and 1605 extending through adapter or inner core 1400 and terminating near the upper end of mallets 1500 and 1600, respectively. Shafts 1505 and 1605 are glued to their respective adapters 1400, as described above in connection with FIG. 11.

The extension of shafts 1505 and 1605 beyond the center of adapter 1400 causes the center of percussion to be moved toward the user. This causes mallets 1500 and 1600 to provide a lighter percussion "feel" for the user than mallets 1110 and 1220 (FIG. 13). In addition, the area of the interface between shafts 1505 and 1605 and their respective adapters 1400 is larger in this configuration. This provides for a stronger, more reliable bond when shafts 1505 and 1605 are glued to their respective adapters 1400.

DESCRIPTION

Alternative Embodiment—Additional Layers—FIGS. 17-22

To provide mallets with additional musical, decorative, and ruggedness characteristics, additional layers are added to layer 400 of mallet 1110 (FIG. 1.1) and layer 1200 of mallet 1220 (FIG. 12). Instead of additional layers of elastomer, two layers of yarn are simultaneously interwoven over layers 400 and 1200 of mallet heads 1105 (FIG. 11) and 1200 (FIG. 12), respectively, to form additional resilient layers which are capable of producing still further distinguishing physical and aesthetic characteristics. Mallets wound with two separate, interwoven layers of yarn are less likely to unravel than a single yarn. The interwoven layers are locked in place and do not move appreciably when striking a hard surface such as a marimba sound bar. Using yarns having two different colors provides a different appearance than a single yarn. Different yarn combinations can be used to create "softer" or "dark" sounds at the base end of a marimba, while other combinations can be used to create "bright" sounds at the treble end.

FIG. 17 shows two separate yarns secured to shaft 1710 prior to wrapping. First and second pieces of yarn 1700 and 1705, respectively, are secured to shaft 1710 by half-hitch knots 1715 and 1720.

Yarns 1700 and 1705 preferably are wound by machine but can be wound by hand. They can be wound with the same or different tensions. If they are wound by hand, the winding is similar to that provided by a machine, as described below.

In FIG. 18, yarn 1700 is pulled from a source 1800, and yarn 1705 is pulled from a source 1805. Yarns 1700 and 1705 may have the same or different physical characteristics. For example, they can be made of the same or different materials. They can have different thicknesses, colors (indicated by HSL—Hue, Saturation, and Light, or an equivalent system), hardnesses, textures, elasticity, weights (measured in TEX units—the mass of yarn per kilometers of length, twist (number of twist rotations per meter), etc. For the case in which the two yarns are different, FIGS. 18-22 show first yarn 1700 as a heavy line, and second yarn 1705 as a lighter line.

At the base end of a marimba, players commonly prefer mallets that produce a "dark" or "softer" sound. These mallets also have a softer striking quality. "Nature spun" 3-ply yarns from the Brown Sheep Company, of Mitchell, Nebr., USA, comprising 100% wool are used in making these mallets. Variations in the "softness" of the sound produced result from winding the yarn with more or less tension.

At the treble end of a marimba, players commonly prefer harder mallets that produce a "bright" sound. These mallets have a harder striking quality. The "Cancun blend" yarn, 70% acrylic fiber and 30% nylon fiber, from the Tamm Yarn Company in Mexico, distributed by the Knit Knack Shop of Peru, Ind. (USA), is preferably used for making these mallets. As above, variations in the "brightness" of the sound produced result from winding the yarn with more or less tension.

The essential components of a winding machine are shown in FIG. 18. A chuck 1810 securely holds shaft 1710 within mallet core 1815. Rotary motive power is supplied to a gear or sprocket 1820, causing chuck 1810 to rotate about the axis of shaft 1710.

String 1700 passes over a tensioning device 1835 then enters a first winding arm 1825. Yarn 1700 exits arm 1825 in the vicinity of mallet core 1815. Similarly, string 1705 passes over a tensioning device 1840 and then enters a second winding arm 1830. Arms 1825 and 1830 are flared at their exit ends, 1826 and 1831 respectively, to prevent fraying of yarns during winding. They are preferably made of rigid metal tubing, with an inner diameter of about 3 mm, sufficient to pass yarns 1700 and 1705 without appreciable resistance.

Winding arm 1825 passes through the center of a gear or sprocket 1845. Arm 1825 is affixed to sprocket 1845. Arm 1825 and sprocket 1845 rotate together about the axis of sprocket 1845 when rotary motive power is applied to sprocket 1845. As arm 1825 rotates, exit end 1826 orbits around mallet core 1815 at an angle to the axis of shaft 1710. Yarn 1700 executes the same orbit as it is wound around core 1815. As yarn 1700 passes beneath core 1815, it is wound on the proximal side of the axis of shaft 1710. As yarn 1700 passes above core 1815, it is wound on the distal side of the axis of shaft 1710. Winding across the axis of shaft 1710, and thus also the axis of core 1815, ensures that yarn 1700 will not slide off and will be securely affixed to core 1815.

Winding arm 1830 is similarly attached to gear or sprocket 1850. Yarn 1705 is wound around core 1815 in the same fashion as yarn 1700. Rotary motive forces are applied synchronously to sprockets 1845, and 1850 in such a way that arms 1825 and 1830 do not collide during winding.

The mechanism (not shown) that supplies the rotary motive forces preferably causes arms 1825 and 1830 to rotate about twelve times for every rotation of chuck 1810. Thus with each rotation of chuck 1810, arms 1825 and 1830 will wrap yarns 1700 and 1705 around core 1815 twelve times. In practice, chuck 1810 executes four full revolutions, resulting in four layers of yarns 1700 and 1705 being wrapped around core 1815. The resultant head comprises core 1815 wrapped with two alternating and interlocked layers of yarn When wrapping is complete, it is necessary to manually secure the ends of yarns 1700 and 1705 in order to prevent unwinding when shaft 1710 and wrapped core 1815 are removed from chuck 1810. As shown in FIG. 19, the ends of yarns 1700 and 1705 are first cut and then threaded through needles 1905 and 1910. Needle 1905 is used to thread yarn 1700 in an over-under pattern around already-wrapped yarns 1700 and 1705 at the end of head 1900 nearest shaft 1901. Similarly, needle 1910 is used to thread yarn 1705 in an over-under pattern around already-wrapped yarns 1700 and 1705 at the top end (away from shaft 1901) of head 1900. Typically six such stitches prevent unwrapping of yarns 1700 and 1705. Yarns 1700 and 1705 are finally trimmed and mallet head 1900 is thereby finished.

FIGS. 19 and 20 show yarns 1705 and 1700 wrapped around a single inner core 400 to form mallet head 1900.

FIGS. 21 and 22 show yarns 1705 and 1700 wrapped around a double inner core comprising layers 400 and 1200 to form mallet head 2100. The stitching operation described above has been completed in these figures.

Yarn overlaid mallets FIGS. 19-22 are used in the same manner as the elastomer-only mallet of FIG. 13. Yarn overlaid mallets provide a softer sound and less tactile feedback to the user than the elastomer-only mallet.

SUMMARY, RAMIFICATIONS, AND SCOPE

Thus we have provided an improved mallet for use with percussion instruments. In a first embodiment, the mallet has a shaft terminating in an adapter within a core having two layers of elastomer. The outer layer is protected by an optional glove made of vinyl, leather, or a similar material. In a second embodiment, a single core is wrapped with two yarns of the same or different types. In a third embodiment, a first inner core is over-molded with a second core, and the resulting core combination is wrapped with two types of yarn. Varying the characteristics of the core and the yarns results in a new and wide variety of characteristics available in mallet performance.

While the above description contains many specificities; it will be apparent that the inventive system is not limited to these and can be practiced with the use of additional hardware and combinations of the various components described. The materials, sizes, and shapes of the components can be varied from those shown and described. For example, materials other than thermoplastic elastomers can be used. The elastomeric material can be liquefied by melting and solidified by cooling, or it can comprise a mixture that is at first liquid then hardened by catalytic action, or it can be a thixotropic compound that flows under extreme pressure then hardens when the pressure is released. Instead of being pure elastomers, the layers comprising the elastomeric mallet cores can be filled with various materials such as tiny metal shot, plastic beads, fibers, sponge material, and the like. The adapter can be made of plastic which is reinforced or not reinforced. Instead of a rounded top, the adapter can have a square top. Instead of a right-circular cylinder, the adapter can have a hexagonal, square, triangular, or other cross-sectional shape. Instead of gluing the adapter to the shaft, it can be held in place with a tight, friction fit, or a screw running from the top of the core, through the adapter, and into the shaft. Instead of wood, the shaft can be made of another material such as plastic or metal.

Accordingly the full scope should be determined by the appended claims and their legal equivalents, rather than the examples given. Also, while the present system employs elements that are well-known to those skilled in the art of mechanical engineering and hardware design, it combines these elements in a novel way which produces a new result not heretofore discovered.

The invention claimed is:

1. A method of fabricating a mallet for use with percussive musical instruments, comprising:

providing an adapter or inner core comprising a solid body of material having a hole therein, molding an elastomeric surrounding core around said adapter or inner core to provide a composite mallet head core having said hole therein and comprising said inner core and said surrounding elastomeric core, inserting a shaft into said hole of said composite mallet head comprising said adapter or inner core with said elastomeric surrounding core, forming a first resilient layer around said mallet head core having said inserted shaft, and forming a second resilient layer around said mallet head core having said inserted shaft.

2. The method of claim 1 wherein said adapter or inner core is made from the group of materials consisting of metal, metallic alloy, plastic, and wood.

3. The method of claim 1 wherein said first resilient layer is an elastomer.

4. The method of claim 1 wherein at least one of said first and said second resilient layers is selected from the group consisting of gloves and yarn.

5. The method of claim 4 wherein said first and said second resilient layers are yarns selected from the group consisting of wool, cotton, metal wire, and plastic filament and said layers are formed by winding them from two yarn sources simultaneously.

6. The method of claim 1 wherein said first resilient layer is formed by molding over said adapter or inner core.

7. The method of claim 1 wherein said second resilient layer is formed by wrapping over said adapter or inner core.

8. The method of claim 1 wherein said first and second resilient layers are formed by interweaving.

9. The method of claim 1 wherein said hole in said adapter is selected from the group consisting of blind holes and through holes.

10. The method of claim 9 wherein said hole is a through hole and said shaft passes through said through hole.

11. A method for making a mallet for use with percussive musical instruments, comprising:

providing a mallet head core comprising an adapter or inner core comprising a solid body of material, molding an elastomeric surrounding core around said adapter or inner core to form a composite mallet head core comprising said inner core and said surrounding elastomeric core, providing a shaft with a handle end and a head end, securing said head end within a hole in said composite mallet head core, overlaying a first resilient layer around said composite mallet head core, overlaying a second resilient layer around said composite mallet head core, whereby said adapter, said elastomeric core, and said first and second resilient layers are securely attached to said head end of said shaft, thereby enabling said mallet to be wielded at said handle end of said shaft.

12. The method of claim 11 wherein said first resilient layer is an elastomer.

13. The method of claim 12 wherein said one of said first and second resilient layers are yarns selected from the group consisting of wool, cotton, metal wire, and plastic filament, and wherein said first and second resilient layers are formed by winding said layers are formed by winding them from two yarn sources simultaneously.

14. The method of claim 13 wherein said yarns are selected from the group consisting of wool, cotton, metal wire, and plastic filament.

15. The method of claim 11 wherein said first resilient layer is molded over said mallet head core.

16. The method of claim 11 wherein said first and second resilient layers are interwoven.

17. The method of claim 11 wherein said second resilient layer is wrapped over said first resilient layer.

18. The method of claim 11 wherein said hole in said adapter is selected from the group consisting of blind holes and through holes.

19. The method of claim 18 wherein said hole is a through hole and said shaft passes through said through hole.

20. A method of fabricating a mallet for use with percussive musical instruments, comprising:

providing an adapter or inner core means comprising a solid body of material, molding an elastomeric surrounding core means around said adapter or inner core means to provide a composite mallet head core, providing an elongated holding means and attaching said holding means to said composite mallet head core for enabling a user to hold said adapter or inner core and strike said adapter or inner core against a percussive musical instrument, forming a first resilient layer around said composite mallet head core with said attached holding means, and forming a second resilient layer around said composite mallet head core with said attached holding means.

21. The method of claim 20 wherein said adapter or inner core means is made from the group consisting of metal, metallic alloy, plastic, and wood.

22. The method of claim 20 wherein said first resilient layer is an elastomer.

23. The method of claim 22 wherein at least one of said first and second resilient layers is chosen from the group consisting of gloves and yarn.

24. The method of claim 23 wherein said first and second resilient layers are yarns selected from the group consisting of wool, cotton, metal wire, and plastic filament, and said layers are formed by winding them from two yarn sources simultaneously.

25. The method of claim 20 wherein said first resilient layer is molded over said adapter or inner core means.

26. The method of claim 20 wherein said first and second resilient layers are interwoven over said adapter or inner core means.

27. The method of claim 20 wherein said second resilient layer is wrapped over said first resilient layer.

28. The method of claim 20 wherein said adapter has a hole therein and said elongated means is inserted into said hole and said hole is selected from the group consisting of blind holes and through holes.

29. The method of claim 28 wherein said adapter has a hole therein and said elongated means is inserted into said hole and said hole is a through hole and said elongated means comprises a shaft that passes through said through hole.

30. A method of fabricating a mallet for use with percussive musical instruments, comprising:

providing an adapter or inner core comprising a solid body of material having a hole, forming an elastomeric core around said adapter or inner core, and securing a shaft within said hole, forming a first resilient layer around said elastomeric core, forming a second resilient layer around said elastomeric core, said first and said second resilient layers each being a yarn selected from the group consisting of wool, cotton, metal wire, and plastic filament, said first and said second resilient layers being formed by winding them from two yarn sources simultaneously so that said first and said second resilient layers are interwoven over said elastomeric core.

* * * * *